US005269238A

United States Patent [19]

Landoni

[11] Patent Number: 5,269,238

[45] Date of Patent: Dec. 14, 1993

[54] QUILTING MACHINE LOOPERS WITH LINKAGE/PISTON DRIVEN THREAD CUTTERS

[75] Inventor: Giannino Landoni, Fagnano Olona, Italy

[73] Assignee: Meca S.P.A., Fagnano Olona, Italy

[21] Appl. No.: 950,103

[22] Filed: Sep. 23, 1992

[30] Foreign Application Priority Data

Jul. 17, 1992 [IT] Italy ..... MI92A001751

[51] Int. Cl.[5] ..... D05B 65/00; D05B 1/10; D05B 57/02

[52] U.S. Cl. ..... 112/117; 112/80.55; 112/166; 112/199; 112/262.1; 112/288; 112/295; 112/301

[58] Field of Search ..... 112/25, 80.3, 80.55, 112/80.56, 80.58, 80.6, 80.7, 80.71, 285, 298, 117, 95, 288, 295, 299, 163, 166, 199, 262.1, 300, 301; 83/909, 910, 955

[56] References Cited

U.S. PATENT DOCUMENTS

| | | | |
|---|---|---|---|
| 1,622,774 | 3/1927 | Fales | 112/117 X |
| 1,796,236 | 3/1931 | Boettcher | 112/117 X |
| 3,532,065 | 10/1970 | Marforio | 112/301 X |
| 3,752,096 | 8/1973 | Mueller | 112/80.55 X |
| 4,461,229 | 7/1984 | Angele et al. | 112/295 X |
| 4,466,366 | 8/1984 | Hirotsu | 112/80.56 |
| 4,470,360 | 9/1984 | Gerlach | 112/117 |
| 4,602,576 | 7/1986 | Cox | 112/80.55 |
| 4,667,611 | 5/1987 | Yamamoto et al. | 112/166 |
| 5,125,351 | 6/1992 | Prais et al. | 112/288 X |

FOREIGN PATENT DOCUMENTS

| | | | |
|---|---|---|---|
| 0179861 | 10/1984 | Japan | 112/80.55 |

*Primary Examiner*—Clifford D. Crowder
*Assistant Examiner*—Ismael Izaguirre
*Attorney, Agent, or Firm*—Panitch Schwarze Jacobs & Nadel

[57] ABSTRACT

An electronically controlled multi-needle quilting machine including linking cylinder arranged between an eccentric integral with a rotating spindle and a lever, to drive in an oscillating motion a number of loopers which, in combination with a number of corresponding needles, perform stiching operations by double chain stitches on a layered material interposed between said members, said linking cylinder comprising a pneumatic cylinder controlled to change the extension of its rod during the various operational steps, whereby the link length is changed and the loopers may reach a position in which, by being provided with a blade they perform a cutting operation on thread of respective needle.

3 Claims, 2 Drawing Sheets

QUILTING MACHINE LOOPERS WITH LINKAGE/PISTON DRIVEN THREAD CUTTERS

BACKGROUND OF THE INVENTION

1. Field of the Invention

This invention concerns quilting machines and it relates in particular to a multi-needle quilting machine with double chain stitches, provided with a thread cutter.

2. Description of the Related Art

As it is known, a large share of the multi-needle quilting machines are presently of the electrically-controlled type, whereby they can be programmed to perform complicated stitching of a large variety of types. In particular, these machines are able to produce arrays of closed, mutually isolated patterns. For that purpose, a quilting machine is controlled in such a way that each needle, once a stitching has been finished, jumps to the next position without performing any stitching, so that an empty area is left between a pair of adjacent patterns.

An important drawback of the known quilting machines is the fact that, between two patterns which have been stitched by the same needle, there is left an unsewn tensioned thread connecting, in particular, the stitching start and end point of a pattern to the corresponding point of the other pattern. Obviously, these superfluous threads have to be manually removed, and this involves longer times and higher costs to get the finished product.

SUMMARY OF THE INVENTION

Therefore, the object of this invention is to provide a multi-needle quilting machine adapted to produce an array of closed pattern designs which are completely isolated from each other already at the end of an automatic manufacturing operation.

Said object is met by an electronically controlled multi-needle quilting machine, including link means arranged between an eccentric mounted on a rotating spindle and a lever to drive, in an oscillatory motion, a plurality of loopers which, in combination with a plurality of corresponding needles, perform a double chain stitching on a layered material interposed between said members, wherein said link means comprise a pneumatic cylinder controlled in such a way that the piston rod thereof projects outside in a variable extent during the various manufacturing steps whereby the length of the link is changed and the loopers reach a position in which, being provided with a blade, they cut the thread of a respective needle.

In addition to completely automating the manufacturing operations making them faster and more cost effective, this quilting machine offers the advantage of repeating the thread cutting with absolute uniformity, whereby the make is extremely homogeneous.

BRIEF DESCRIPTION OF THE DRAWINGS

The above and other advantages of the machine according to this invention will become apparent from the following detailed description of an embodiment thereof.

DESCRIPTION OF THE PREFERRED EMBODIMENTS

Figure 1:
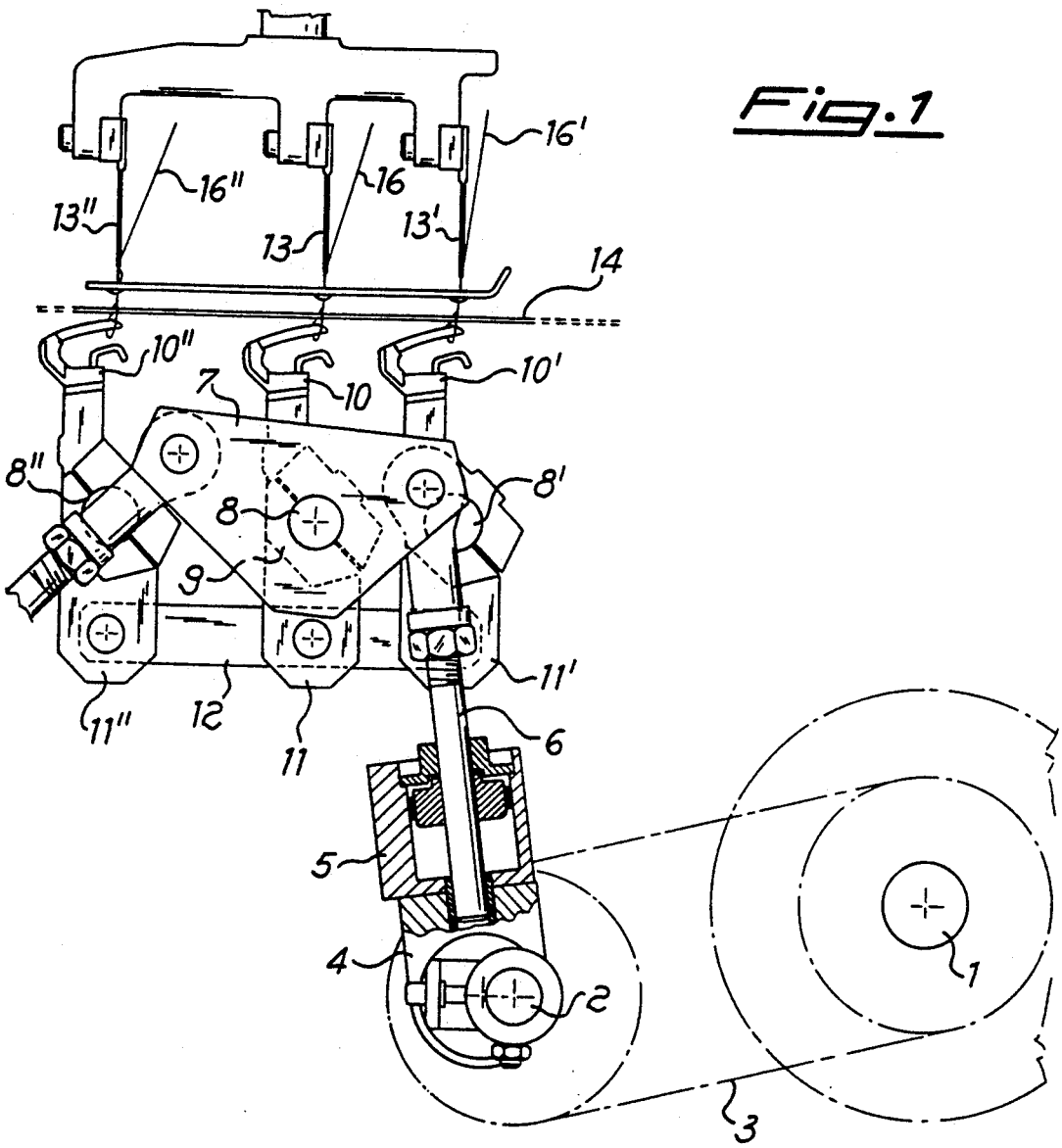
FIG. 1 is a schematic side elevational view of a port ion of a quilting machine according to this invention, during the stitching step.
Figure 2:
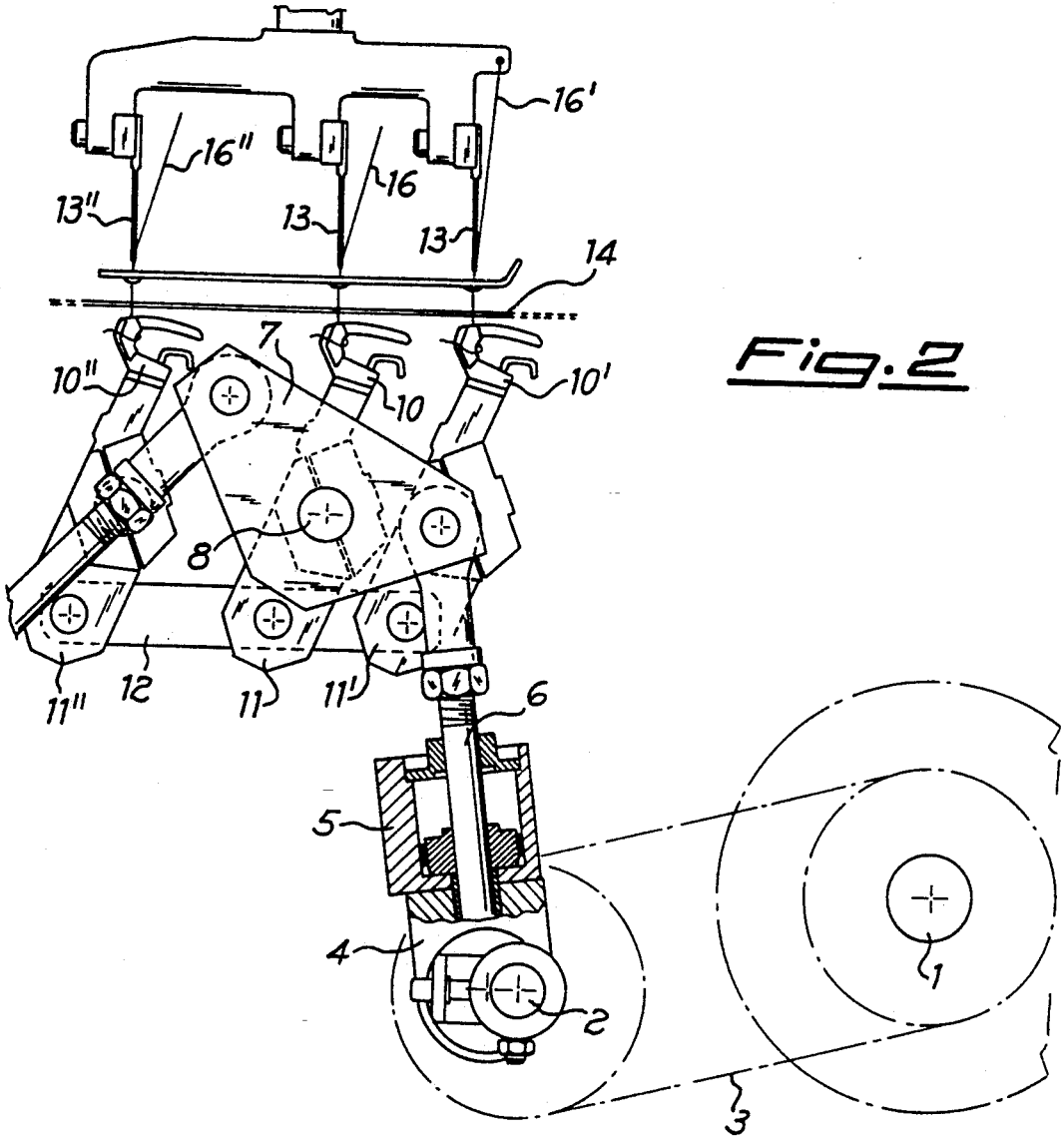
FIG. 2 is a schematic side elevational view of the same portion of the machine shown in FIG. 1 during a thread cutting operation.

Referring now to FIG. 1, the quilting machine according to this invention is shown to include a main spindle 1 which drives a secondary spindle 2 parallel thereto, by means of a belt 3 mounted on suitable pulleys. On spindle 2 there is mounted an eccentric 4 integral with a pneumatic cylinder 5 whose rod 6 is connected to an end of a substantially triangularly shaped lever 7. Said lever is pivoted on a shaft 8 carrying fastened thereon supports 9 of a first row of loopers 10 parallel to each other, only the first of which is visible in this figure. A second and a third row of loopers 10', 10'' are located on the front and rear side of said first row and pivoted around shafts 8', 8'' parallel to said first shaft 8, while at the ends of said shafts there are fastened respective levers 11, 11', 11'', hingedly connected by a transverse bar 12.

Above the three rows of loopers, suitable dragging rollers (not shown) cause a sliding motion of the layered material 14 (which in the following, for sake of simplicity, is called fabric) which is operated upon by means of three rows of needles 13, 13' and 13'', each of which is positioned at a respective looper 10, 10', 10''. During the stitching step shown in FIG. 1, rod 6 of pneumatic cylinder 5 is kept in a position of maximum extension, while said cylinder is actuated in a substantially reciprocating motion by means of eccentric 4 mounted on spindle 2. Therefore, cylinder 5 behaves like a link and it should be noted that in the known quilting machines, a link is in fact provided in place of cylinder 5.

According to what has been said above, lever 7 is driven in an oscillating motion and it subjects to an alternating rotary motion both shaft 8 integral therewith and shafts 8' and 8'' through bar 12 and levers 11, 11' and 11''.

Therefore, all the loopers of the machine are subjected to an oscillating motion and, in combination with the motion of the corresponding needles, they perform the double chain stitching used for quilting fabric 14. It should be noted that each double chain stitch is made by two threads only one of which, shown at 16, 16', 16'' passes through a respective needle 13, 13', 13''. It should further be noted that in this step each looper cooperates to working on the fabric with its upper portion only.

When a machine operating cycle is over, i. e. when each needle has finished its stitching, the quilting machine control unit stops needles 13, 13', 13'' in a raised position relative to fabric 14, and with respective threads 16, 16', 16'' loaded on corresponding loopers 10, 10', 10'', while also main spindle is stopped. Said threads, that during the stitching operations were substantially braked, are left free, and fabric 14 is moved forward through a span whose length may be programmed in order to control the length of the portion of thread inserted through the needle, with which the operation will have to be resumed next.

At this point, after threads 16, 16', 16'' have been locked again through means already known, pneumatic cylinder 5 is biased in such a way as to bring rod 6 thereof in the minimum extension position, whereby lever is rotated and, according to what has been said above, the same thing takes place for loopers 10, 10', 10". In particular, the central row of loopers driven directly by lever 7, transmits an identical motion to the front and back row of loopers through bar 12 and levers 11, 11', 11", whereby all the loopers result to be located in the position shown in the drawing, corresponding to a substantially larger rotation compared to the one performed during a regular oscillating motion during the stitching step.

The figure shows that, following the above described motion, each thread 16, 16', 16" slides all the way to the neck of a respective looper 10, 10', 10" and it is in this point that the thread gets cut.

Figure 3:
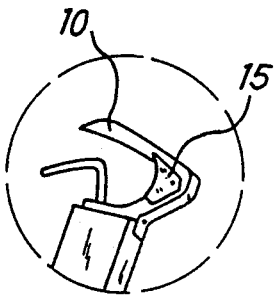
FIG. 3 is a view of a detail of the subject machine.

In fact, FIG. 3 shows that, at the neck of each looper 10 there is mounted a blade 15 for cutting the thread and, once said operation has been performed, the machine is brought back to the Figure condition, and the normal stitching cycle is resumed.

It should be noted that, when using a quilting machine according to this invention, in addition to doing completely away with the manual thread cutting step, it is possible to program the automatic cutting of said thread in such a way that the final look is improved. In fact, by dragging fabric 14 along a suitable span in the step ahead of thread cutting, "thread tails" are obtained (i.e. lengths of thread going from the cutting point to the needles eye) long enough to make it possible to resume normally the stitching operation after the cutting operation, but short enough to prevent the cut end of the thread to be left outside the surface of the fabric once the stitching has been resumed. It should eventually be noted that the subject machine can go through the sequence of operations necessary for the thread cutting cycle within few seconds, therefore without any substantial influence on the production times.

It is understood that pneumatic cylinder 5 may be replaced by any known device, suitable for moving rod 6 according to the ways described herein above, while loopers 10, blades 15 mounted thereon, and all the mechanical components mentioned above may be of any other type suitable for their purpose.

Therefore, the above and further modifications may be made by those skilled in this art to the quilting machine according to this invention without exceeding the scope of protection of this invention as defined in the appended claims.

I claim:

1. An electronically controlled multi-needle quilting machine comprising:

a rotating spindle;

an eccentric mounted on the rotating spindle;

a lever;

one or more loopers having respective needles and cutting blades; and link means coupled to the eccentric and the lever for actuating, by an oscillating motion, the loopers such that the loopers in combination with the respective needles perform double chain stitching operations on a fabric proximate the loopers and needles;

the link means comprising a pneumatic cylinder and a rod, the rod being driven by the pneumatic cylinder to thereby vary a length of the rod and consequently a length of the link means during operation of the quilting machine, such that the loopers and the respective cutting blades are suitably positioned to cut needle thread.

2. The machine according to claim 1, further comprising:

means for interrupting driving of the loopers and the needles after one of the double chain stitching operations is complete;

means for advancing the fabric a predetermined distance relative to the loopers and the needles; and means for applying a predetermined tension to needle thread inserted in each of the needles, such that the quilting machine is prepared to perform another of the double chain stitching operations.

3. In an electronically-controlled multi-needle quilting machine comprising a rotating spindle, an eccentric mounted on the rotating spindle, a lever, one or more loopers having respective needles and cutting blades, and like means coupled to the eccentric and the lever, the link means comprising a pneumatic cylinder and a rod, a method of performing a sewing operation on a fabric comprising the steps of:

actuating, using the link means, the loopers such that the loopers in combination with the respective needles perform double chain stitching operations on a fabric proximate the loopers and needles;

driving the rod using the pneumatic cylinder to thereby vary a length of the rod and consequently a length of the link means during operation of the quilting machine, such that the loopers and the respective cutting blades are suitably positioned to cut needle thread;

interrupting driving of the loopers and the needles after one of the double chain stitching operations is complete;

advancing the fabric a predetermined distance relative to the loopers and the needles; and applying a predetermined tension to needle thread inserted in each of the needles, such that the quality machine is prepared to perform another of the double chain stitching operations.

* * * * *